US006345637B1

(12) United States Patent
Ko

(10) Patent No.: US 6,345,637 B1
(45) Date of Patent: Feb. 12, 2002

(54) AUTOMATIC OPENING WIND RESISTANT UMBRELLA STRUCTURE MADE OF FIBERGLASS REINFORCED PLASTICS (FRP)

(76) Inventor: Chin Sung Ko, No. 27-1, Lane 188, Sec. 3, Chin Mar Road, Changhua City (TW)

( * ) Notice: Subject to any disclaimer, the term of this patent is extended or adjusted under 35 U.S.C. 154(b) by 0 days.

(21) Appl. No.: 09/643,936

(22) Filed: Aug. 23, 2000

(51) Int. Cl.[7] ..... A45B 25/16

(52) U.S. Cl. ..... 135/22; 135/29; 135/31; 135/32

(58) Field of Search ..... 135/22, 23, 29, 135/31, 32

(56) References Cited

U.S. PATENT DOCUMENTS

| | | | | | |
|---|---|---|---|---|---|
| 429,160 | A | * | 6/1890 | Sprague | 135/32 |
| 946,122 | A | * | 1/1910 | Garrett | 135/32 |
| 987,208 | A | * | 3/1911 | Wolfe | 135/32 X |
| 5,472,006 | A | * | 12/1995 | Kuo et al. | 135/31 |
| 6,076,540 | A | * | 6/2000 | You | 135/22 |
| 6,158,452 | A | * | 12/2000 | You | 135/23 X |

FOREIGN PATENT DOCUMENTS

| | | | | |
|---|---|---|---|---|
| FR | 747527 | * | 6/1933 | 135/29 |
| GB | 1240610 | * | 7/1971 | 135/22 |

* cited by examiner

*Primary Examiner*—Laura A. Callo
(74) *Attorney, Agent, or Firm*—Rosenberg, Klein & Lee

(57) ABSTRACT

An improved automatic opening wind resistant umbrella structure made of fiberglass reinforced plastics (FRP) mainly uses an innovative connection mechanism to associate secondary umbrella stretchers with umbrella ribs and has advantages of simplified construction and reinforced combination strength. The automatic opening wind resistant FRP umbrella structure according to the invention provides excellent convenience in use.

1 Claim, 4 Drawing Sheets

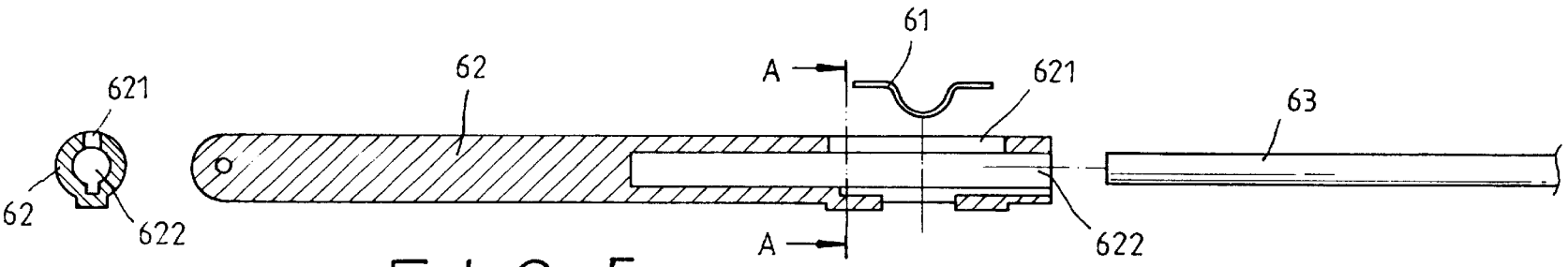
FIG. 5
FIG. 6
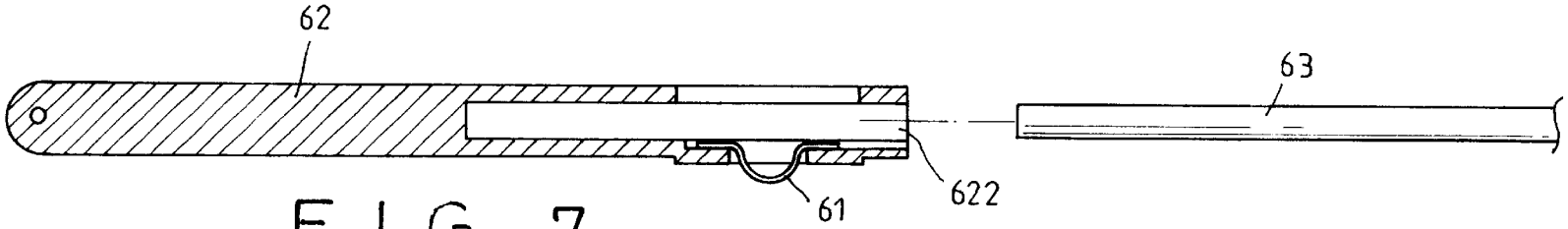
FIG. 7
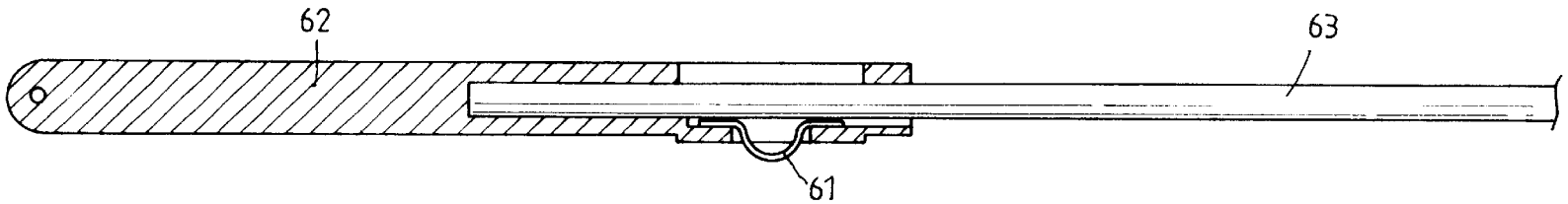
FIG. 8

AUTOMATIC OPENING WIND RESISTANT UMBRELLA STRUCTURE MADE OF FIBERGLASS REINFORCED PLASTICS (FRP)

BACKGROUND OF THE INVENTION

Most of wind resistant umbrellas that are made of fiberglass reinforced plastics (FRP) and provide better convenience in use have such an automatic opening structure as shown in FIGS. 1 and 2. It comprises umbrella strut stretchers (1) and ribs (2) respectively connected to a runner (3), in association with a main stretcher (4) and a shaft rod (5). In such a structure, an umbrella strut stretcher (1) is coupled on the middle segment with the outer end of a rib (2). Thus the middle segment of umbrella strut stretcher (1) is configured to be coupling means (11) provided with a holding opening to which the outer end of a rib is attached. The coupling means (11) is further provided on two opposite ends with openings to accommodate the ends of the front and the rear segment of an umbrella strut stretcher (1) and form an integrated strut stretcher. Such a combination needs additional parts, which in turn leads to a complicated construction and tedious assembling work. It does not meet economical and efficient requirements.

In view of the problems above mentioned, the primary object of the invention is to provide an improved FRP umbrella stretcher used in an automatic opening umbrella that has a simplified configuration and is an advancement in technologies. It can promote the performance of an umbrella. Now the features and structure of the invention will be described in detail with reference to the accompanying drawings.

BRIEF DESCRIPTION OF THE ACCOMPANYING DRAWINGS

FIG. 5 is a partial cross sectional plan view showing an umbrella strut stretcher according to the invention.

FIG. 6 is a cross sectional view taken along the A—A line of FIG. 5.

FIG. 7 is a cross sectional view showing the umbrella strut stretcher of FIG. 5 in a partially assembled state.

FIG. 8 is a cross sectional view showing the umbrella strut stretcher of FIG. 5 in an integrated state.

DETAILED DESCRIPTION OF THE INVENTION

Figure 1:
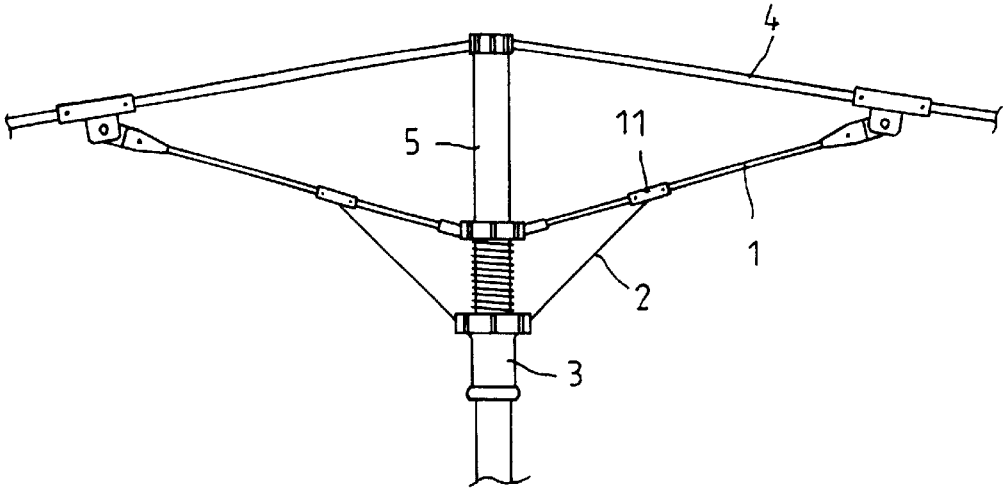
FIG. 1 (prior art)
FIG. 1 is a plan view showing a prior art FRP wind resistant umbrella in an assembled state.
Figure 2:
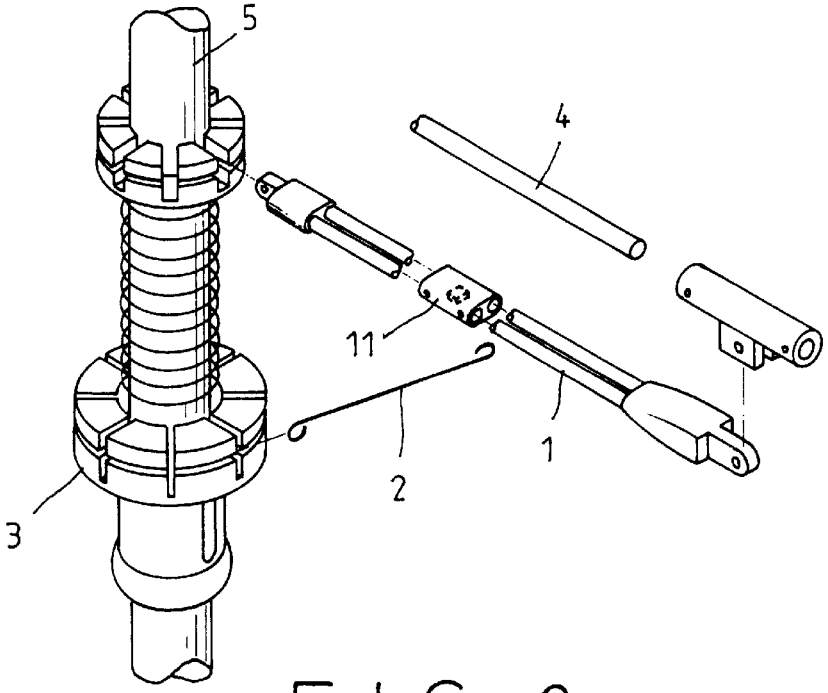
FIG. 2 (prior art)
FIG. 2 is a partially exploded view depicting the parts of a prior art FRP wind resistant umbrella.
Figure 3:
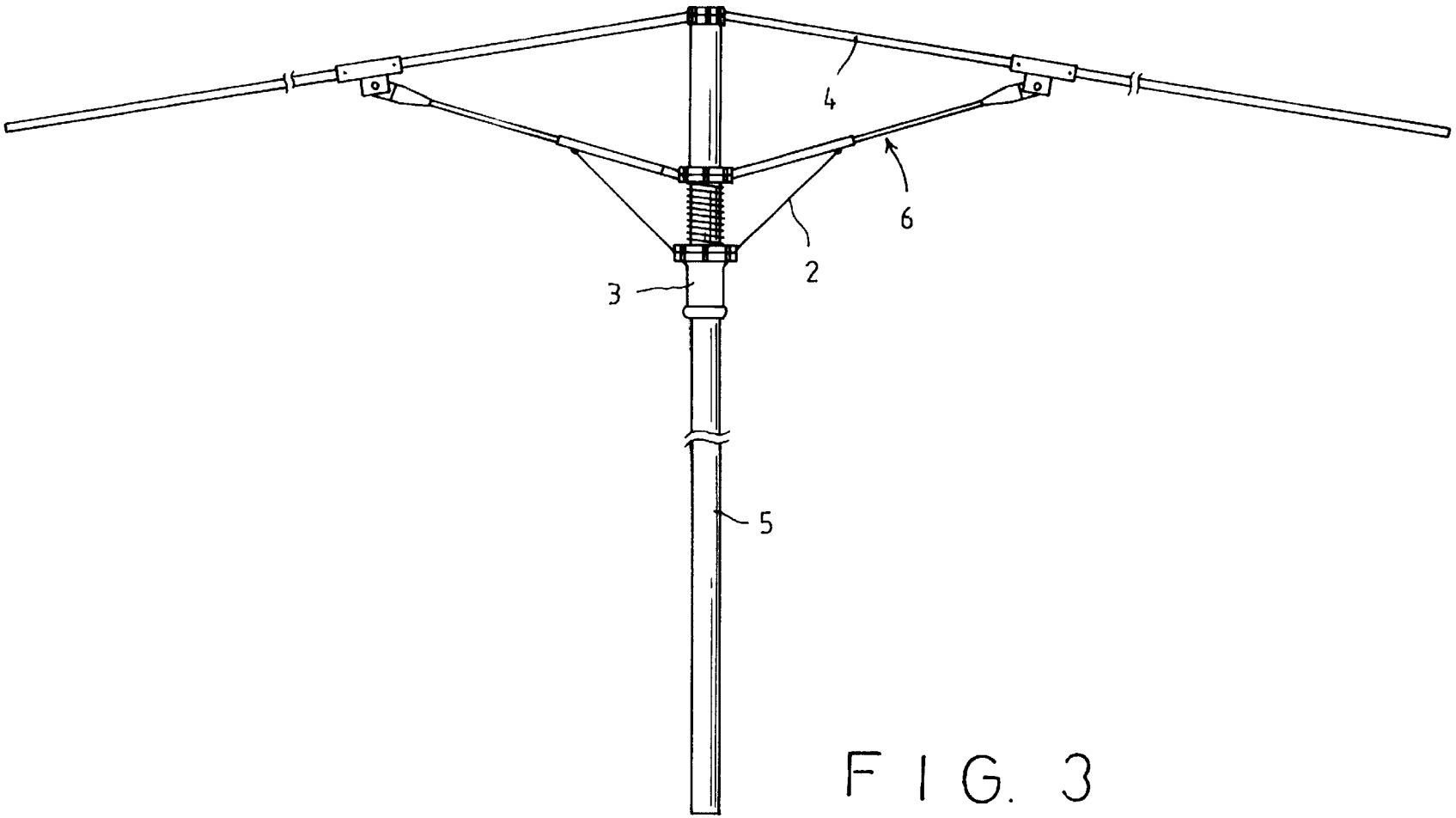
FIG. 3 is a plan view illustrating an umbrella stretcher system according to the invention.
Figure 4:
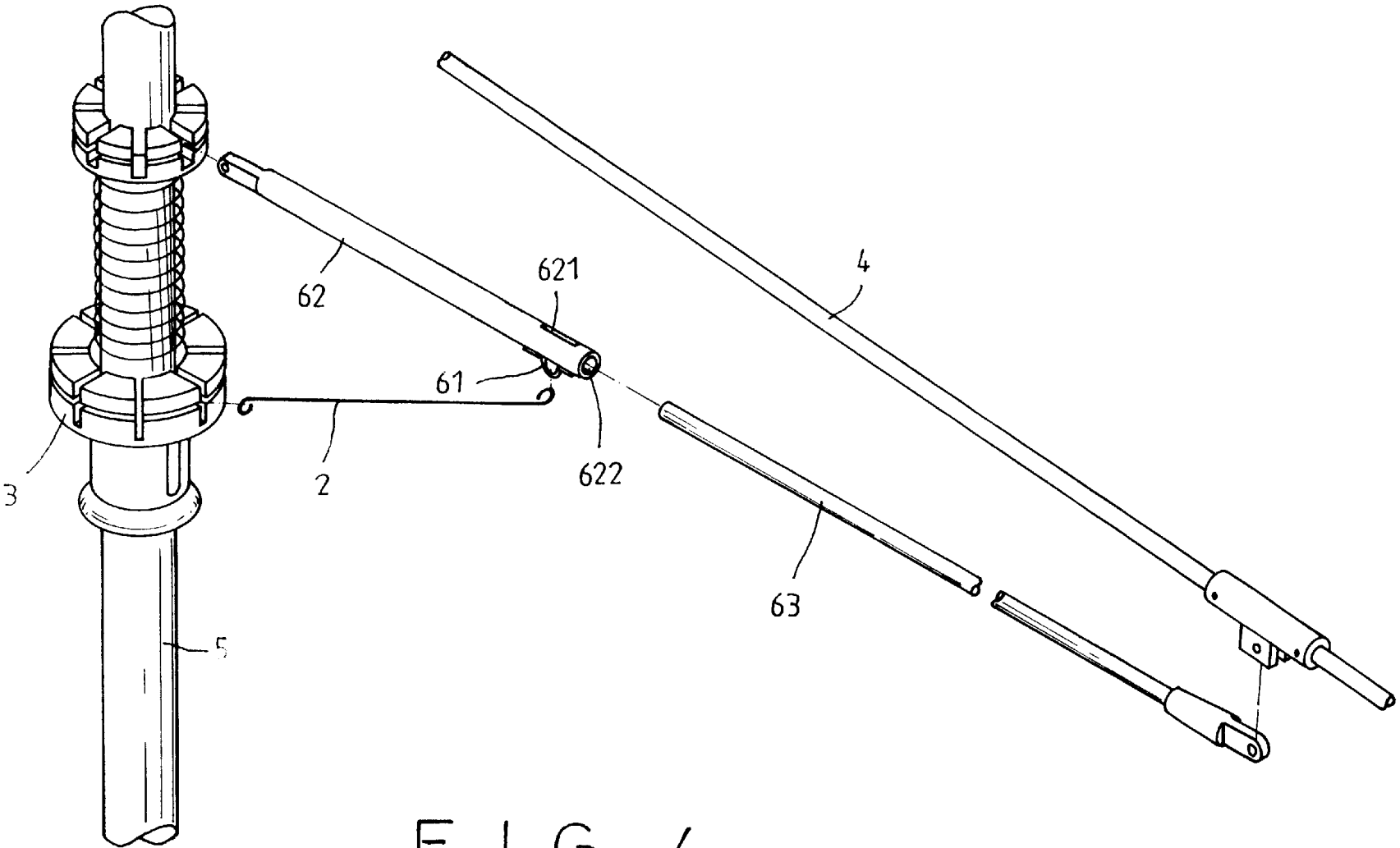
FIG. 4 is an exploded view partially indicating the parts of an umbrella stretcher system according to the invention.

Referring to FIGS. 3 through 6, the invention mainly comprises improvements made on an umbrella strut stretcher. The improved umbrella strut stretcher can be combined with a prior art connection rib (2), a runner (3), a main stretcher (4) and a main shaft rod (5) to form an automatic opening wind resistant umbrella. In the structure, an umbrella strut stretcher (6) consists of an inner rod (62) and an outer rod (63). The inner rod (62) is provided on the outer side surface near the outer end 25 with a slot (621) extending through the rod in a radial direction. The slot has a larger opening at the top and a smaller opening at the bottom so that a hook (61) can be placed into the slot (621) from the top of the slot and seated therein with the curved portion of the hook (61) extending to the outside. The inner rod (62) is further provided on the outer end with an opening (622) in the axial direction that accommodates the inner end of the outer rod (63) so that two rods are combined into an integrated umbrella strut stretcher (6).

In operation, the exposed curved portion of the hook (61) provides a connection means to which the outer end of an umbrella rib (2) can be attached in a simple way. The integrity of the improved umbrella strut stretcher enhances the strength and assemblage efficiency of the entire structure. By means of a metal hook (61) that can be easily connected with a rib, an umbrella strut stretcher according to the invention can increase the combination strength and stability of an umbrella and thus is a technical advancement. Evidently the invention has the essence of a patent.

What is claimed is:

1. An improved FRP automatic opening wind resistant umbrella structure comprising improved umbrella strut stretchers that are made of fiberglass reinforced plastic material and are in association with ribs, a runner, main stretchers and a shaft rod to form an umbrella stretcher system; and characterized in that said umbrella strut stretcher consists of an inner rod and an outer rod;

said inner rod being provided on the outer side surface near the outer end thereof with a slot extending in a radial direction through the inner rod with a larger opening on the top and a smaller opening on the bottom so that a hook can be placed into the slot from the top of the slot and seated therein with a curved portion extending to the outside, said inner rod being further provided on the outer end thereof with an axial opening that accommodates the inner end of said outer rod to form an integrated umbrella strut stretcher, and the exposed curved portion of said hook providing means to which an umbrella rib can be directly attached in a simple and easy way.

* * * * *